US008341766B2

(12) United States Patent
Rodriguez et al.

(10) Patent No.: US 8,341,766 B2
(45) Date of Patent: Jan. 1, 2013

(54) JACKET

(75) Inventors: Amanda Marie Rodriguez, Carlsbad, CA (US); Patricia Elizabeth Dahan, Temecula, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 770 days.

(21) Appl. No.: 12/099,614

(22) Filed: Apr. 8, 2008

(65) Prior Publication Data

US 2009/0249529 A1 Oct. 8, 2009

(51) Int. Cl.
*A41D 1/02* (2006.01)

(52) U.S. Cl. ..... 2/97; 2/93; 2/98

(58) Field of Classification Search ..... 2/85, 86, 2/92, 93, 94, 95, 97, 98, 101, 108, 129, 269, 2/115, 125

See application file for complete search history.

(56) References Cited

U.S. PATENT DOCUMENTS

| | | | | | |
|---|---|---|---|---|---|
| 1,177,952 | A | * | 4/1916 | Inman | 2/93 |
| 1,195,738 | A | | 8/1916 | Rose | |
| 1,489,080 | A | * | 4/1924 | Lee | 2/122 |
| 1,525,322 | A | * | 2/1925 | Post | 2/84 |
| 1,980,394 | A | * | 11/1934 | Falcon | 2/98 |
| 2,063,469 | A | * | 12/1936 | Smith | 2/94 |
| 2,102,251 | A | * | 12/1937 | Arst | 2/84 |
| 2,281,510 | A | * | 4/1942 | Neumark | 2/97 |
| 2,291,025 | A | * | 7/1942 | Casella | 2/93 |
| 2,301,527 | A | * | 11/1942 | English et al. | 2/95 |
| 2,302,368 | A | * | 11/1942 | Evans | 2/94 |
| 2,318,617 | A | * | 5/1943 | Miller | 2/98 |
| 2,369,416 | A | * | 2/1945 | Solomon | 2/115 |
| 2,457,356 | A | * | 12/1948 | Enck | 2/93 |

(Continued)

FOREIGN PATENT DOCUMENTS

DE 202 09 081 U 8/2002

(Continued)

OTHER PUBLICATIONS

International Search Report for PCT/US2009/002109, mailed Dec. 29, 2009, 2 pg.

(Continued)

*Primary Examiner* — Alissa L Hoey

(74) *Attorney, Agent, or Firm* — Sterne, Kessler, Goldstein & Fox P.L.L.C.

(57) ABSTRACT

A jacket has several features useful for participating in a sport while wearing the jacket. The jacket may have a shell with a pocket in an upper region of the shell and a semi-rigid collar located in the pocket, wherein the semi-rigid collar is movable between a storage position wherein the semi-rigid collar is in the pocket and a use position wherein the semi-rigid collar is partially removed from the pocket. The jacket may also have a shoulder region with discrete areas of gripping material located on the shoulder region. The jacket may also have an inner core wrap having a perimeter, wherein a portion of the perimeter is removably attached to the outer shell that hugs the torso of a wearer. The jacket may also have a sleeve and a gusset formed on an outer surface of the sleeve by folding material forming the sleeve at an inner angle of the wearer's elbow, wherein the gusset unfolds and the sleeve lengthens when the arm of a wearer is straightened and wherein the gusset refolds and the sleeve shortens when the arm of the wear is bent.

16 Claims, 4 Drawing Sheets

U.S. PATENT DOCUMENTS

| | | | | | |
|---|---|---|---|---|---|
| 2,493,370 | A | * | 1/1950 | Smith | 2/94 |
| 2,534,978 | A | * | 12/1950 | Lapedes | 2/97 |
| 2,594,259 | A | * | 4/1952 | Fitch | 2/97 |
| 2,617,106 | A | * | 11/1952 | Pritzker | 2/97 |
| 2,651,041 | A | * | 9/1953 | Sunderland et al. | 2/97 |
| 2,682,056 | A | * | 6/1954 | Werber | 2/84 |
| 2,694,202 | A | * | 11/1954 | Macrides | 2/115 |
| 2,716,754 | A | * | 9/1955 | Hirsch | 2/227 |
| 2,834,966 | A | * | 5/1958 | Zimmerman | 2/84 |
| 2,914,773 | A | * | 12/1959 | Walter | 2/269 |
| 2,948,899 | A | * | 8/1960 | Allen | 2/94 |
| 2,994,089 | A | * | 8/1961 | Ferguson, Jr. et al. | 2/81 |
| 3,049,719 | A | * | 8/1962 | Carmen | 2/93 |
| 3,122,753 | A | * | 3/1964 | Smith | 2/94 |
| 4,017,908 | A | | 4/1977 | Murnane | |
| 4,068,316 | A | * | 1/1978 | Haywood | 2/126 |
| 4,338,686 | A | * | 7/1982 | Bell | 2/93 |
| 4,392,258 | A | * | 7/1983 | O'Neill | 2/209.12 |
| 4,470,155 | A | * | 9/1984 | Maeshima | 2/108 |
| 4,509,213 | A | * | 4/1985 | Harvey | 2/22 |
| 4,669,125 | A | * | 6/1987 | Allen | 2/459 |
| 4,696,066 | A | * | 9/1987 | Ball et al. | 2/272 |
| 4,728,538 | A | * | 3/1988 | Kaspar et al. | 427/288 |
| 4,771,479 | A | * | 9/1988 | Silver | 2/85 |
| 4,864,656 | A | * | 9/1989 | Nesse | 2/97 |
| 4,882,786 | A | * | 11/1989 | Gross | 2/94 |
| 4,922,552 | A | * | 5/1990 | Grilliot et al. | 2/93 |
| 4,999,850 | A | * | 3/1991 | Grilliot et al. | 2/126 |
| 5,033,127 | A | * | 7/1991 | Schmeltz | 2/269 |
| 5,115,516 | A | | 5/1992 | Golde | |
| 5,138,717 | A | | 8/1992 | Tolton | |
| 5,163,183 | A | * | 11/1992 | Smith | 2/81 |
| 5,218,720 | A | | 6/1993 | Tolton | |
| 5,319,806 | A | * | 6/1994 | Hermann et al. | 2/461 |
| 5,337,418 | A | * | 8/1994 | Kato et al. | 2/456 |
| 5,369,809 | A | * | 12/1994 | Hall | 2/202 |
| 5,400,438 | A | | 3/1995 | Staff et al. | |
| 5,692,239 | A | * | 12/1997 | Lewis | 2/125 |
| 5,758,363 | A | * | 6/1998 | Winfree | 2/122 |
| 5,822,794 | A | * | 10/1998 | Allred | 2/115 |
| 5,886,089 | A | | 3/1999 | Knowlton | |
| 5,978,965 | A | * | 11/1999 | Summers | 2/69 |
| 6,175,958 | B1 | * | 1/2001 | Wu | 2/2.5 |
| 6,195,802 | B1 | | 3/2001 | Armellino | |
| 6,279,161 | B1 | * | 8/2001 | Johnston | 2/69 |
| 6,499,141 | B1 | * | 12/2002 | Egnew | 2/69 |
| 6,654,968 | B2 | | 12/2003 | Braun et al. | |
| 6,665,878 | B1 | * | 12/2003 | Way | 2/84 |
| 6,745,405 | B2 | * | 6/2004 | Blauer et al. | 2/456 |
| 6,874,162 | B2 | | 4/2005 | Boezi | |
| 6,895,597 | B1 | * | 5/2005 | Rakic | 2/93 |
| 6,978,481 | B2 | * | 12/2005 | Mordecai et al. | 2/81 |
| D531,389 | S | * | 11/2006 | Farshid et al. | D2/853 |
| 7,191,470 | B2 | * | 3/2007 | Benini | 2/69 |
| 7,305,717 | B1 | * | 12/2007 | Brown | 2/114 |
| 7,322,050 | B2 | * | 1/2008 | Heatherly | 2/244 |
| 7,636,950 | B2 | * | 12/2009 | Melhart et al. | 2/69 |
| 40,299 | A1 | * | 1/2010 | Dossman | 2/122 |
| 7,730,553 | B2 | * | 6/2010 | Benini | 2/94 |
| 7,748,056 | B2 | * | 7/2010 | Mickle | 2/115 |
| 7,779,485 | B2 | * | 8/2010 | Gandy | 2/84 |
| 7,784,116 | B2 | * | 8/2010 | Gallo et al. | 2/267 |
| 7,958,569 | B2 | * | 6/2011 | Razzaghi et al. | 2/62 |
| 2005/0081277 | A1 | * | 4/2005 | Matechen et al. | 2/102 |
| 2005/0114978 | A1 | * | 6/2005 | Benini | 2/69 |
| 2005/0160520 | A1 | * | 7/2005 | Forrest | 2/255 |
| 2005/0229283 | A1 | * | 10/2005 | Towle et al. | 2/93 |
| 2006/0053526 | A1 | * | 3/2006 | Beland et al. | 2/115 |
| 2006/0272071 | A1 | | 12/2006 | Mickle | |
| 2007/0000010 | A1 | | 1/2007 | Benini | |
| 2009/0151044 | A1 | * | 6/2009 | Shimshony | 2/84 |

FOREIGN PATENT DOCUMENTS

| | | |
|---|---|---|
| WO | WO 01/35774 A1 | 5/2001 |

OTHER PUBLICATIONS

Written Opinion of the International Searching Authority, mailed Dec. 29, 2009, 7 pgs.

* cited by examiner

JACKET

BACKGROUND OF THE INVENTION

1. Field of the Invention

The present invention is directed to a jacket having features useful for participating in a sport while wearing the jacket.

2. Background Art

During inclement weather, such as when it is rainy or windy, athletes participating in outdoor sports, such as golf often wear a jacket for protection. However, such jackets are often uncomfortable and restrict the movement of the wearer while participating in a sport. For example, golfers bend over slightly when putting the ball and this exposes the neck to rain such that the neck gets wet and rain drips down the back. While jackets often have hoods, which would protect the neck from rain when bending over, golfers cannot wear a hood while hitting the ball because it obstructs their view. Also, when a jacket is wet the shoulder region becomes slick and shoulder straps attached to various articles, such as a golf bag, easily slip of the wearer's shoulder.

An additional problem with such jackets is the tendency for the jacket to "bunch-up" along the sleeves or body of the jacket. The bunching of excess material is unsightly and may restrict movement of the wearer, such as when the wearer is swinging an object or throwing an object. Golfers also extend their arms when swinging and putting, which can cause the wrist openings of the sleeves of a conventional jacket to creep up along the forearm and expose the wrists to the elements.

The jacket of the present invention overcomes the above-mentioned problems.

BRIEF SUMMARY OF THE INVENTION

In one embodiment according to the present invention, a jacket comprises a shell having an upper region; a pocket located adjacent the upper region of the shell; and a semi-rigid collar located in the pocket, wherein the semi-rigid collar is movable between a storage position wherein the semi-rigid collar is in the pocket and a use position wherein the semi-rigid collar is partially removed from the pocket, and wherein the semi-rigid collar protects the neck of the wearer when in the use position.

In another embodiment according to the present invention, a jacket comprises a shoulder region having a front and a back and discrete areas of gripping material located on the shoulder region on both the front and the back of the shoulder region.

In another embodiment according to the present invention, a jacket comprises an outer shell comprising a lower edge with a length; and an inner core wrap comprising a perimeter, wherein a portion of the perimeter is removably attached to the outer shell; and a lower edge with a length wherein the length of the lower edge of the inner core wrap is smaller than the length of the lower edge of the outer shell so that the inner core wrap hugs the torso of a wearer.

In another embodiment according to the present invention, a jacket comprises a sleeve and a gusset formed on an outer surface of the sleeve by folding material forming the sleeve at an inner angle of a wearer's elbow, wherein the gusset unfolds and the sleeve lengthens when the arm of a wearer is straightened and wherein the gusset refolds and the sleeve shortens when the arm of the wearer is bent.

In another embodiment according to the present invention, a jacket comprises an outer shell having an upper region and a lower edge with a length; a pocket located adjacent the upper region of the outer shell; a semi-rigid collar located in the pocket, wherein the semi-rigid collar is movable between a storage position wherein the semi-rigid collar is in the pocket and a use position wherein the semi-rigid collar is partially removed from the pocket, and wherein the semi-rigid collar protects the neck of the wearer when in the use position; a shoulder region having a front and a back; discrete areas of gripping material located on the shoulder region on both the front and the back of the shoulder region; an inner core wrap comprising a perimeter, wherein a portion of the perimeter is removably attached to the outer shell and wherein the inner core wrap hugs the torso of a wearer and a lower edge with a length wherein the length of the lower edge of the inner core wrap is smaller than the length of the lower edge of the outer shell; a sleeve; and a gusset formed on an outer surface of the sleeve by folding material forming the sleeve at an inner angle of a wearer's elbow, wherein the gusset unfolds and the sleeve lengthens when the arm of a wearer is straightened and wherein the gusset refolds and the sleeve shortens when the arm of the wearer is bent.

BRIEF DESCRIPTION OF THE DRAWINGS/FIGURES

DETAILED DESCRIPTION OF THE INVENTION

Figure 1:
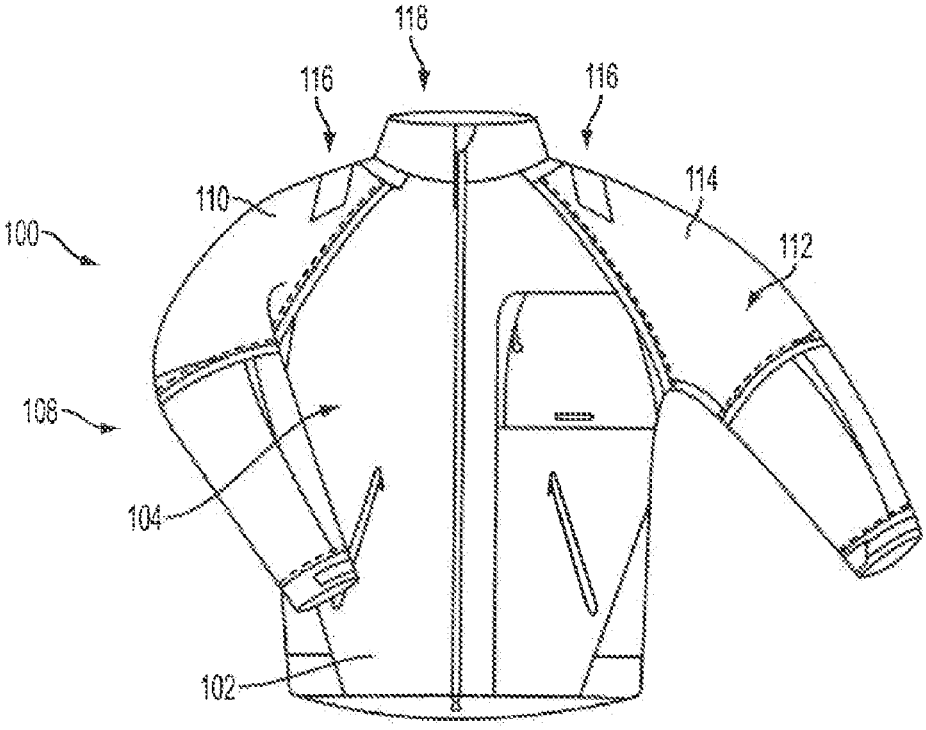
FIG. 1 is a front view of an exemplary jacket according to the present invention.

An exemplary jacket 100 of the present invention is shown in FIGS. 1-9. Jacket 100 has an outer shell 102 with a front side 104, a back side 106, a right sleeve 108 with a right shoulder region 110, and a left sleeve 112 with a left shoulder region 114. Jacket 100 may be worn by athletes during inclement weather, such as when it is rainy, chilly, or windy, and has several features for protecting the wearer from the weather and minimizing the effects of wearing jacket 100 while participating in a sport or other athletic activity. In a preferred embodiment outer shell 102 may be made of polyester, such as a 2.5 soft shell polyester comprising a full outer layer of polyester, a full layer of a polyurethane microfilm laminated to the inside of the outer layer of polyester, and a half layer of pigment printed on the polyurethane microfilm such that the polyurethane microfilm is between the full outer layer of polyester and the half layer of printed pigment.

Figure 2:
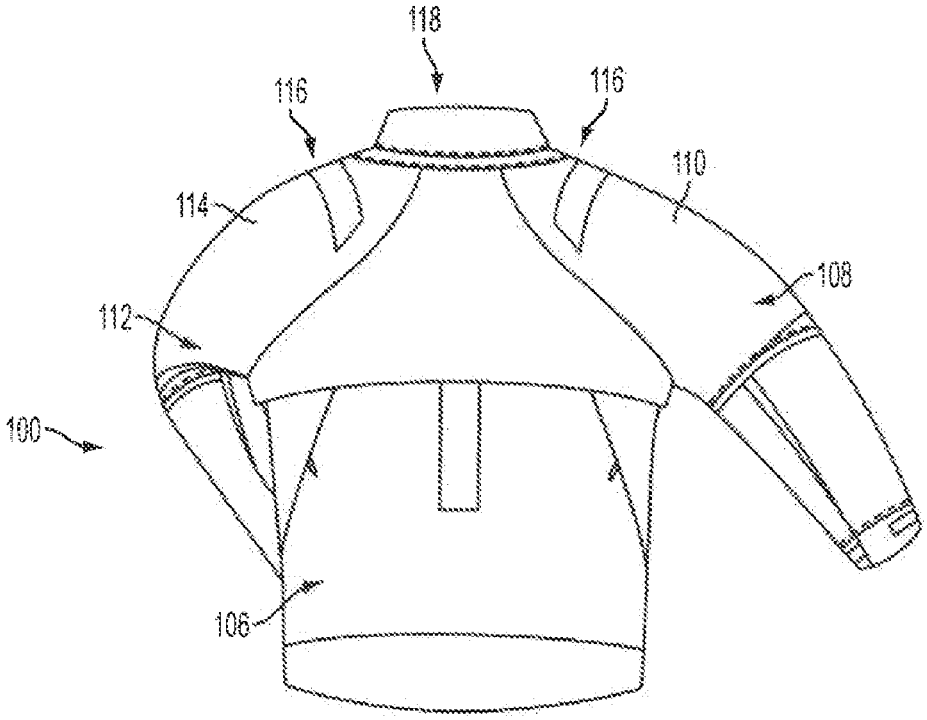
FIG. 2 is a back view of the exemplary jacket of FIG. 1.
Figure 3:
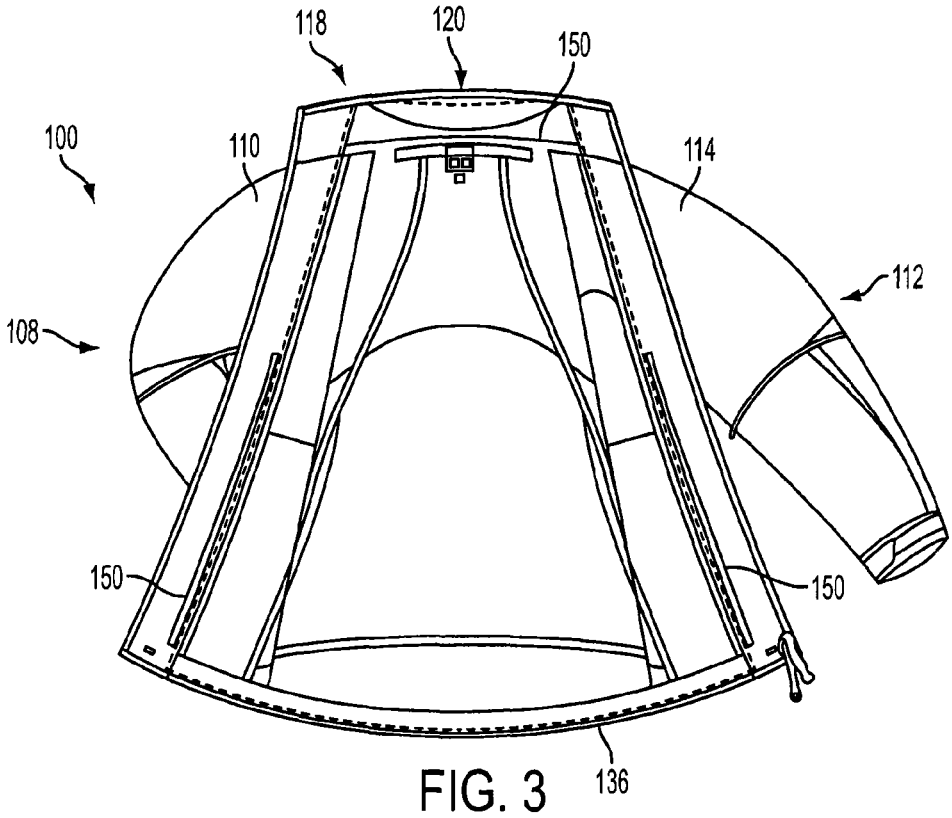
FIG. 3 is a view of the inside of the exemplary jacket of FIG. 1 with an inner core wrap removed.

In one embodiment, as shown in FIGS. 1 and 2, right shoulder region 110 and/or left shoulder region 114 have discrete areas of gripping material 116. Gripping material 116 may span one or both shoulder regions 110, 114 from front side 104 of shell 102 to back side 106 of shell 102. In some embodiments, the discrete areas of gripping material 116 are limited to shoulder regions 110, 114. The discrete areas of gripping material 116 may be in the form of one or more stripes. Gripping material 116 may be dot-shaped deposits of silicone on shell 102. The discrete areas of gripping material 116 are useful for gripping a shoulder strap attached to a bag or other article to prevent the shoulder strap from slipping of shoulder regions 110, 114 of jacket 100. While discrete stripes are shown in the Figures, gripping material 116 may also be in the form of circles, squares, and other patterns. In a preferred embodiment, the gripping material is made of silicone rubber.

Figure 4:
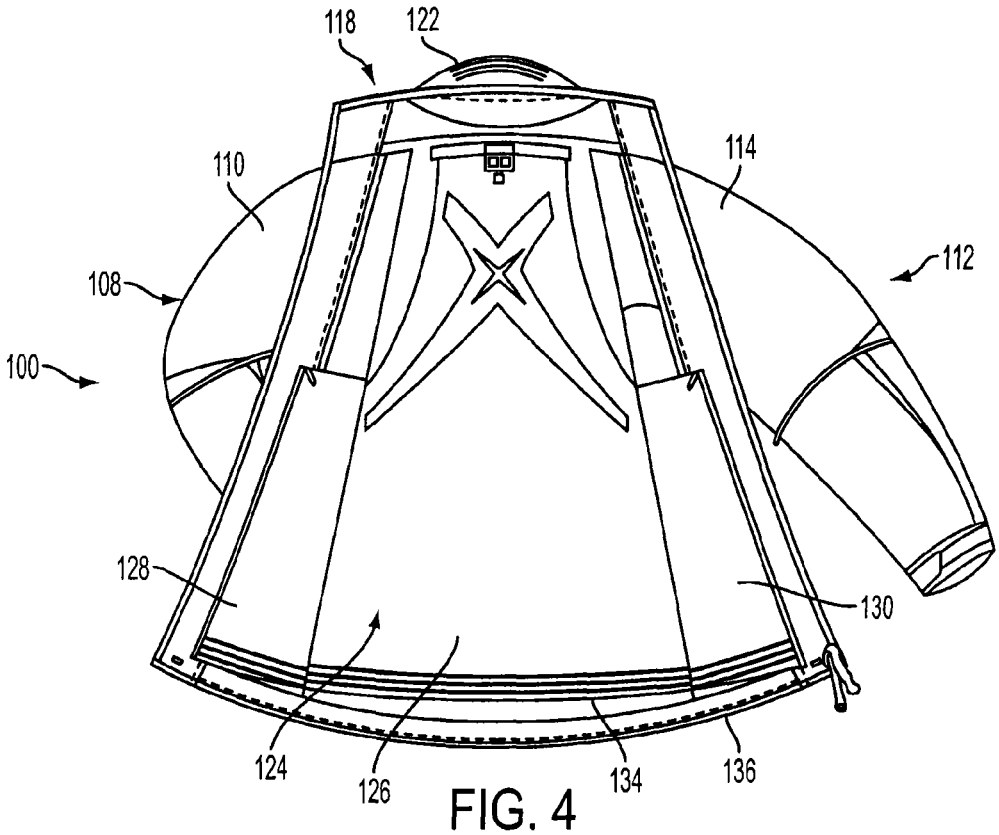
FIG. 4 is a view of the inside of the exemplary jacket of FIG. 1 with the inner core wrap attached.
Figure 5:
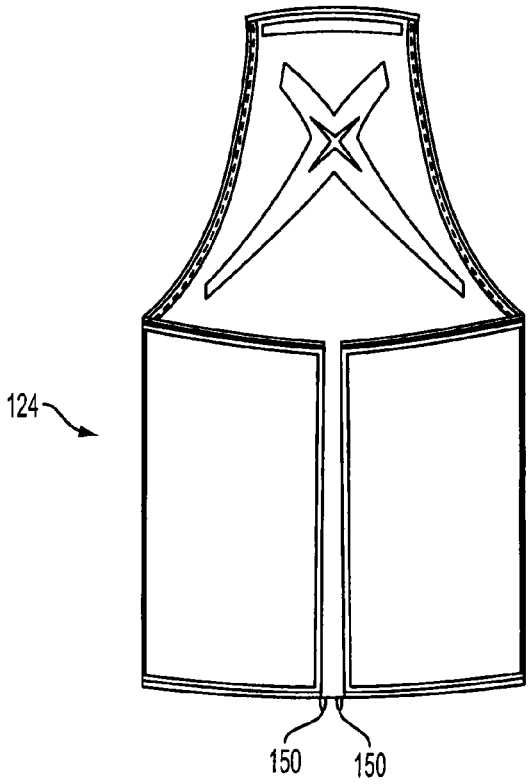
FIG. 5 is a front view of an exemplary inner core wrap according to the present invention in a folded state.
Figure 6:
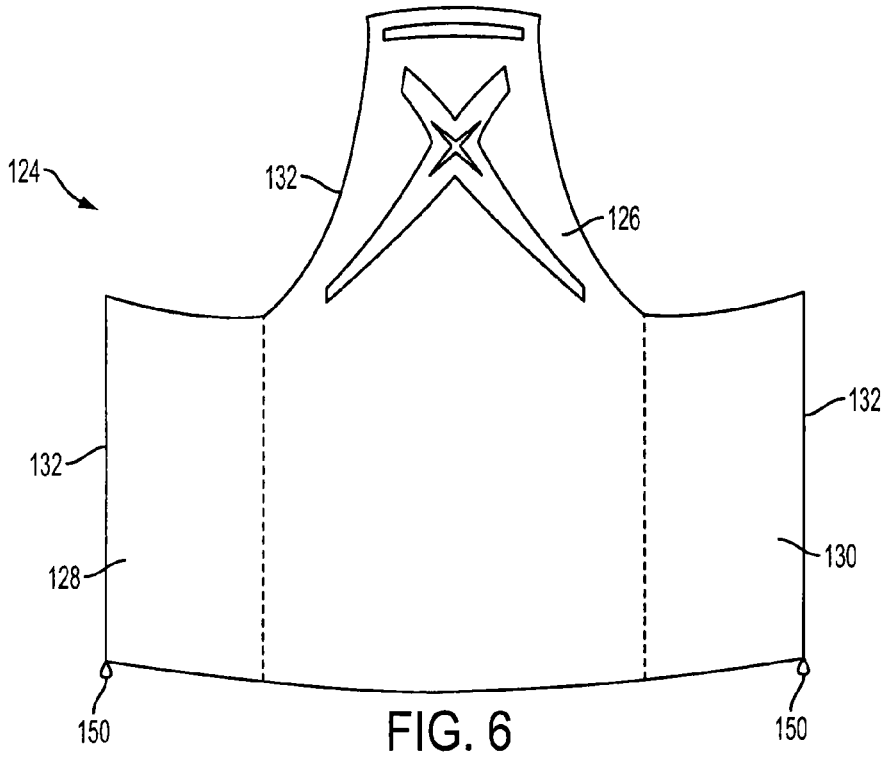
FIG. 6 is a front view of the exemplary inner core wrap of FIG. 5 in an unfolded state.
Figure 7:
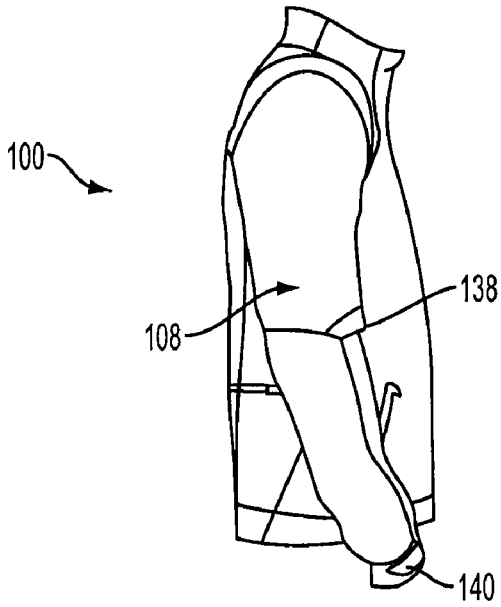
FIG. 7 is a side view of the exemplary jacket of FIG. 1

As shown in FIGS. 1-4, in one embodiment, shell 102 of jacket 100 has an upper region 118 that includes an opening for the neck of the wearer. A pocket 120 is located adjacent upper region 118 of shell 102. Pocket 120 may be located at an opening for the neck of the wearer. A collar 122 is located in pocket 120 and is movable between a storage position wherein collar 122 is in pocket 120 (see FIG. 3) and a use position wherein collar 122 is at least partially removed from pocket 120, as shown in FIG. 4. In some embodiments, collar 122 does not extend around the entirety of the opening for the neck of the wearer. In some embodiments, collar 122 extends above the opening for the neck of the wearer when in the use position. In some embodiments, collar 122 extends above the upper region of shell 102 when in the use position. Collar 122 may be semi-rigid so that it does not flap or fold when in the use position. Collar 122 may be particularly useful in protecting the neck of the wearer. For example, golfers often bend over slightly when striking a golf ball, thereby exposing the neck such that when it is raining, rain hits the neck and drips down the back of the golfer. Collar 122 may protect the neck of the wearer in such situations such that rain hits the collar 122 and drips down back side 106 of jacket 100 rather than the back of the wearer. Similarly, collar 122 may also shade the neck of the wearer from the sun to prevent sunburn. In a preferred embodiment, collar 122 is preferably made of polyester, such as a 2.5 soft shell polyester comprising a full outer layer of polyester, a full layer of a polyurethane microfilm laminated to the inside of the outer layer of polyester, and a half layer of pigment printed on the polyurethane microfilm such that the polyurethane microfilm is between the full outer layer of polyester and the half layer of printed pigment, and is attached to upper region 118 by stitching. Pocket 120 may have a closure mechanism such as a mechanical fastener or a hook and loop type fastener to keep pocket 120 closed when collar 122 is disposed in pocket 120.

In one embodiment, as shown in FIGS. 3-6, jacket 100 may have an inner core wrap 124 removably attached to the interior of shell 102. Inner core wrap 124 may have a main body 126 with a right side flap 128 on the right side of main body 126 and a left side flap 130 on the left side of main body 126. In some embodiments, inner core wrap 124 does not extend over the shoulders of a wearer. Inner core wrap has a perimeter 132, which may be removably attached to shell 102 at various points through the use of fasteners 150, including, but not limited to mechanical fasteners, such as zippers, and hook and loop type fasteners. Main body 126 of inner core wrap 124 aligns with the interior of back side of shell 102 and right side flap 128 and left side flap 130 align with the interior of right side and left side of shell 102, respectively. Accordingly, when inner core wrap 124 is attached to shell 102, main body 126 covers the back of a wearer and right side and left side flaps 128, 130 wrap around and hug the torso of the wearer.

Inner core wrap 124 may have a lower edge 134 with a length and outer shell 102 may have a lower edge 136 with a length. The length of lower edge 134 of inner core wrap 124 is shorter than the length of the lower edge 136 of outer shell 102 and as a result inner core wrap 124 hugs the torso of the wear when jacket 100 is worn. This also prevents jacket 100 from bunching-up at the waist or bubbling-out in the back, thereby minimizing interference by the material of jacket 100 with the wearer while participating in a sport or other athletic activity. In a preferred embodiment, inner core wrap 124 is preferably made of a blend of polyester and a block copolymer of polyurethane and polyethylene glycol, such as spandex, also known a LYCRA®, a trademark of Invista.

In one embodiment right sleeve 108 and/or left sleeve 112 may have a gusset 138 formed on an outer surface of the sleeve in the region of a wearer's elbow. FIGS. 7-10 show an exemplary gusset 138 on right sleeve 108 of jacket 100. This feature will be discussed with respect to right sleeve 108, however a similar gusset 138 may also be present on left sleeve 112.

Figure 9:
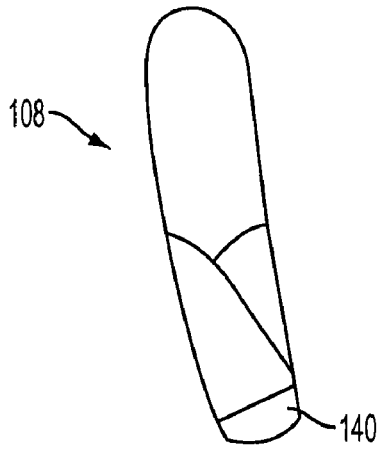
FIG. 9 is a side view of the exemplary sleeve of FIG. 8 in a lengthened state.
Figure 10:
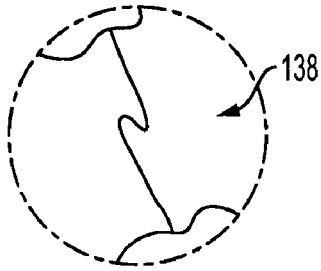
FIG. 10 is an exploded view of an exemplary gusset according to the present invention.

Gusset 138 may be formed by folding material of sleeve 108 onto itself in an accordion fashion, forming an accordion fold at an inner angle of a wearer's elbow, such that gusset 138 unfolds and sleeve 108 lengthens when the arm of the wearer is straightened, as shown in FIG. 9.

Figure 8:
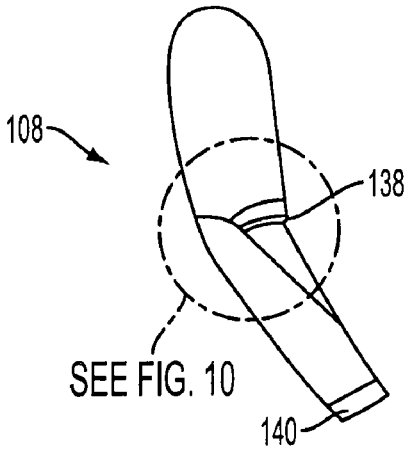
FIG. 8 is a side view of an exemplary sleeve according to the present invention in a shortened state.

Gusset 138 refolds and sleeve 108 shortens when the arm of the wearer is bent, as shown in FIG. 8. Gusset 138 may be a single fold or may be multiple folds. A fold line can be formed in the sleeve at an inner angle of the wearer's elbow, and it certain embodiments can extend transversely across the sleeve. Wrist opening 140 of sleeve 108 may be adjustable to tighten sleeve 108 against the wrist of a wearer to maximize the lengthening effect of gusset 138.

Gussets 138 minimize bunching-up of sleeves 108, 112 in the area of the elbow when the arm of the wearer is bent, such as in putting. This is beneficial for many athletes that swing their arms to strike objects, such as in baseball, softball, tennis, or golf or throw objects such as in football, baseball, or softball as bunching of material of jacket 100 at the elbow of sleeves 108, 112 may alter the wearer's swing or throw.

Jacket 100 is designed to overcome and/or minimize the problems athletes have observed when wearing jackets while participating in a sport or other activity which requires the wearer to move his head and/or arms.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A jacket comprising:

an outer shell having an upper region and a lower edge with a length;

a pocket located adjacent the upper region of the outer shell;

a semi-rigid collar located in the pocket, wherein the semi-rigid collar is movable between a storage position wherein the semi-rigid collar is in the pocket and a use position wherein the semi-rigid collar is partially removed from the pocket, and wherein the semi-rigid collar protects the neck of the wearer when in the use position;

a shoulder region having a front and a back;

discrete areas of gripping material located on the shoulder region on both the front and the back of the shoulder region;

an inner core wrap comprising:

a perimeter, wherein a portion of the perimeter is removably attached to the outer shell; and a lower edge with a length wherein the length of the lower edge of the inner core wrap is smaller than the length of the lower edge of the outer shell so that the inner core wrap hugs the torso of the wearer;

a sleeve; and a gusset comprising a fold line formed in the sleeve at an inner angle of the wearer's elbow, wherein the gusset unfolds and the sleeve lengthens in response to straightening of the arm of the wearer and wherein the gusset refolds and the sleeve shortens in response to bending of the arm of the wearer.

2. The jacket of claim 1, wherein the gripping material includes silicone.

3. The jacket of claim 1, wherein the discrete areas of gripping material are in the form of a stripe.

4. The jacket of claim 1, wherein each shoulder region has a plurality of stripes formed from the discrete areas of gripping material.

5. The jacket of claim 1, wherein the inner core wrap comprises a blend of polyester and a block copolymer of polyurethane and polyethylene glycol.

6. The jacket of claim 1, wherein the inner core wrap covers the wearer's back.

7. The jacket of claim 1, further comprising a fastener for removably attaching the inner core wrap and the outer shell.

8. The jacket of claim 1, wherein a wrist opening of a sleeve is adjustable to tighten against the wrist of the wearer.

9. The jacket of claim 1 further comprising:

a second shoulder region having a front and a back; and discrete areas of gripping material located on the second shoulder region on both the front and the back of the second shoulder region.

10. The jacket of claim 1, further comprising:

a second sleeve; and a second gusset comprising a second fold line formed in the second sleeve at an inner angle of the wearer's elbow, wherein the second gusset unfolds and the second sleeve lengthens in response to straightening of the arm of the wearer—and wherein the second gusset refolds and the second sleeve shortens in response to bending of the arm of the wearer.

11. The jacket of claim 1, wherein the gusset comprises two fold lines.

12. The jacket of claim 1, wherein the semi-rigid collar does not flap or fold when in the use position and when in the storage position.

13. The jacket of claim 1, wherein the discrete areas of gripping material are limited to the shoulder region.

14. The jacket of claim 1, wherein the inner core wrap does not extend over the shoulders of a wearer.

15. The jacket of claim 1, wherein the gusset comprises an accordion fold.

16. The jacket of claim 1, wherein the fold line extends transversely across the sleeve.

* * * * *

UNITED STATES PATENT AND TRADEMARK OFFICE

CERTIFICATE OF CORRECTION

PATENT NO. : 8,341,766 B2
APPLICATION NO. : 12/099614
DATED : January 1, 2013
INVENTOR(S) : Rodriguez et al.

It is certified that error appears in the above-identified patent and that said Letters Patent is hereby corrected as shown below:

In the Specifications:

Col. 4, line 25: “and it certain” should be --and in certain--

In the Claims:

Col. 6, line 16 (claim 10): “wearer—and” should be --wearer and--

Signed and Sealed this
Thirteenth Day of August, 2013

Teresa Stanek Rea
*Acting Director of the United States Patent and Trademark Office*